US006039242A

United States Patent [19]

Tee

[11] Patent Number: 6,039,242

[45] Date of Patent: Mar. 21, 2000

[54] C-FOLD MAILER/INTERMEDIATE WITH CERTIFIED RETURN RECEIPT

[75] Inventor: M. Richard Tee, Reno, Nev.

[73] Assignee: Moore U.S.A. Inc., Grand Island, N.Y.

[21] Appl. No.: 09/160,183

[22] Filed: Sep. 25, 1998

[51] Int. Cl.[7] ..... B65D 27/34

[52] U.S. Cl. ..... 229/92.1; 462/65

[58] Field of Search ..... 229/92.1; 462/5, 462/65; 283/116

[56] References Cited

U.S. PATENT DOCUMENTS

| | | | |
|---|---|---|---|
| 3,837,565 | 9/1974 | Johnsen . | |
| 4,682,793 | 7/1987 | Walz . | |
| 4,840,306 | 6/1989 | Lombardo . | |
| 4,915,287 | 4/1990 | Volk . | |
| 5,183,203 | 2/1993 | Sanders . | |
| 5,190,210 | 3/1993 | Walz . | |
| 5,288,014 | 2/1994 | Meyers et al. . | |
| 5,294,041 | 3/1994 | Whiteside | 229/92.1 |
| 5,476,420 | 12/1995 | Manning . | |
| 5,626,286 | 5/1997 | Petkovsek | 229/300 |
| 5,664,725 | 9/1997 | Walz | 229/300 |
| 5,752,647 | 5/1998 | Schubert et al. | 229/92.1 |
| 5,860,904 | 1/1999 | Petkovsek | 229/92.1 |
| 5,862,978 | 1/1999 | Forrest | 229/300 |
| 5,890,647 | 4/1999 | Petkovsek | 229/92.1 |
| 5,901,903 | 5/1999 | Sanders et al. | 229/300 |

*Primary Examiner*—Stephen P. Garbe
*Attorney, Agent, or Firm*—Nixon & Vanderhye P.C.

[57] ABSTRACT

A C-fold type business form having three panels formed from a single sheet of paper that is C-folded about fold lines is specifically adapted to be used for certified or registered mail. Certified or registered mail return receipt indicia is imaged on the third panel first and second faces, including a signature line imaged on the third panel first face, and a plurality of lines of weakness are formed in the third panel to define a return receipt card with the return receipt indicia on it. Certified or registered mail notification indicia is imaged on the second panel first face, as well as variable outgoing address indicia. Green printing is provided on the third panel in at least the area of the return receipt card. The return receipt card is readily removable from the rest of the mailer with a minimum of perf lines provided, but optionally with tacking adhesive adjacent the return receipt card holding the third and first panels together.

20 Claims, 4 Drawing Sheets

C-FOLD MAILER/INTERMEDIATE WITH CERTIFIED RETURN RECEIPT

BACKGROUND AND SUMMARY OF THE INVENTION

There is a continuing need for specialty type of certified or registered mailer type business forms that are simple and easy to use, yet provide an effective return receipt card, and sufficient area for indicia so that the form is versatile and informative. According to the present invention, a mailer type business form is provided which is easily formed merely by printing on a single sheet of paper (which may at one point during processing be in web form, and which may be easily printed to provided a certified or registered return receipt form including a readily removable return receipt card. The form according to the invention is extremely simple yet practical.

According to one embodiment of the present invention, a C-fold mailer type business form intermediate is provided comprising the following components: A sheet of paper having first and second faces, first and second end lines substantially parallel to each other, and first and second side lines substantially parallel to each other and substantially perpendicular to the end lines. First and second fold lines substantially parallel to the end lines and forming the sheet into first, second and third panels. First and second lines of weakness spaced from but adjacent the side lines and substantially parallel thereto, defining first and second tear-off edges. First patterns of adhesive or cohesive formed in the tear-off edges for holding the sheet in a mailer configuration when folded about the fold lines to provide the first panel between the second and third panels. Certified or registered mail return receipt indicia imaged on the third panel first and second faces, including a signature line imaged on the third panel first face. A plurality of lines of weakness formed in the third panel adjacent the return receipt indicia to define a readily removable return receipt card with the return receipt indicia thereon. Certified or registered mail notification indicia imaged on the second panel first face. And an outgoing address indicia area on the second panel first face for receipt of variable outgoing address indicia thereon.

Preferably the intermediate further comprises variable outgoing address indicia imaged on the outgoing address indicia area, and the notification indicia and the return receipt card have substantially the same variable indicia identification string (typically a combination of letters and numbers), imaged thereon.

Preferably, the second end line comprises an end edge, and the second end edge comprises a first edge of the return receipt card, devoid of sealing (as opposed to tacking) adhesive connection to the first panel along the first edge. Preferably, the signature line indicia is adjacent the second end edge, that is at the first edge of the return receipt card. Also, preferably the second end edge is significantly longer than the fist edge of the return receipt card, the second end edge having an overlap area; and the intermediate further comprises a second adhesive or cohesive pattern disposed on at least one of the third panel second face adjacent the second end edge and the first panel first face adjacent the first fold line, to hold the first and third panels together in the overlap area when the intermediate is C-folded about the fold lines with the first panel between the second and third panels.

The third panel first and second faces, at least in the area encompassed by the return receipt card, are preferably printed green, that is with a green ink background so the return receipt card looks just like a conventional return receipt card. Green background printing is also preferably provided in the area of the certified or registered mail notification indicia area on the second panel first face. Also, preferably one of the lines of weakness defining the return receipt card comprises one of the first or second lines of weakness.

In the preferred embodiment the first patterns of adhesive or cohesive comprise cooperating patterns of pressure activated cohesive provided in the tear-off edges on the first panel first and second faces, second panel second face only, and third panel second face only. Preferably the second pattern comprises cooperating spots of pressure activated cohesive provided on both the third panel second face and the first panel third face. The pressured activated cohesive may be that sold commercially by Toppan Forms of Japan under the trade designation "TN124", and such as shown in U.S. Pat. Nos. 4,918,128, 5,190,818, 5,314,944 and 5,427,851.

The intermediate according to the invention may also comprise cooperating third patterns of pressure activated cohesive disposed along the first end line on the second face, and second fold line on the second face in the first panel, to hold the first and second panels together when Z-folded about the fold lines.

According to another aspect of the present invention a C-fold mailer type business form intermediate is provided comprising the following components: A sheet of paper having first and second faces, first and second end lines substantially parallel to each other, and first and second side lines substantially parallel to each other and substantially perpendicular to the end lines. First and second fold lines substantially parallel to the end lines and forming the sheet into first, second and third panels. First and second lines of weakness spaced from but adjacent the side lines and substantially parallel thereto, defining first and second tear-off edges. First patterns of adhesive or cohesive formed in the tear-off edges for holding the sheet in a mailer configuration when folded about the fold lines to provide the first panel between the second and third panels. Certified or registered mail return receipt indicia imaged on the third panel first and second faces, including a signature line imaged on the third panel first face. A plurality of lines of weakness formed in the third panel adjacent the return receipt indicia to define a readily removable return receipt card with the return receipt indicia thereon. And wherein the second end line comprises an end edge, and wherein the second end edge comprises a first edge of the return receipt card, devoid of sealing adhesive connection to the first panel along the first edge.

The details of the intermediate according to this aspect of the invention may be the same as described above with respect to the first aspect.

According to another aspect of the present invention, a certified or registered receipt requested mailer type business form is provided comprising the following components: A top panel having a top face with outgoing address indicia and certified or registered mail notification indicia thereon including a variable indicia identification string. An intermediate panel between the top panel and a bottom panel. The bottom panel has a bottom face with certified or registered return receipt indicia imaged thereon including a signature line and substantially the same variable indicia identification string. A plurality of lines of weakness defining a portion of the bottom panel, which portion contains the return receipt indicia, into a return receipt card. Green printing on the bottom panel bottom face in at least the area of the return receipt card. First and second tear-off strips formed adjacent opposite side edges of the panels and defined by lines of weakness. And adhesive or cohesive holding the intermediate panel to the top and bottom panels at least at the tear-off strips.

In the mailer the return receipt card typically has an edge adjacent the signature line indicia defined by a first edge of the bottom panel, and the bottom and intermediate panels are devoid of sealing (as opposed to tacking) adhesive thereat; also one of the lines of weakness defining the return receipt card preferably comprises one of the lines of weakness defining the tear-off edges. The mailer also typically further comprises adhesive or cohesive acting between the bottom and intermediate panels along the first edge of the bottom panel but spaced from the return receipt card.

In the intermediate and mailer type business form described above, instead of the intermediate or form comprising the indicated components, it may consist essentially of only the recited components.

It is the primary object of the present invention to provide a simple but effective mailer type business form, and an intermediate for producing the form, which are effective in providing a return-receipt card for certified and registered mail pieces. This and other objects of the invention will become clear from an inspection of the detailed description of the invention and from the appended claims.

DETAILED DESCRIPTION OF THE DRAWINGS

Figure 1:
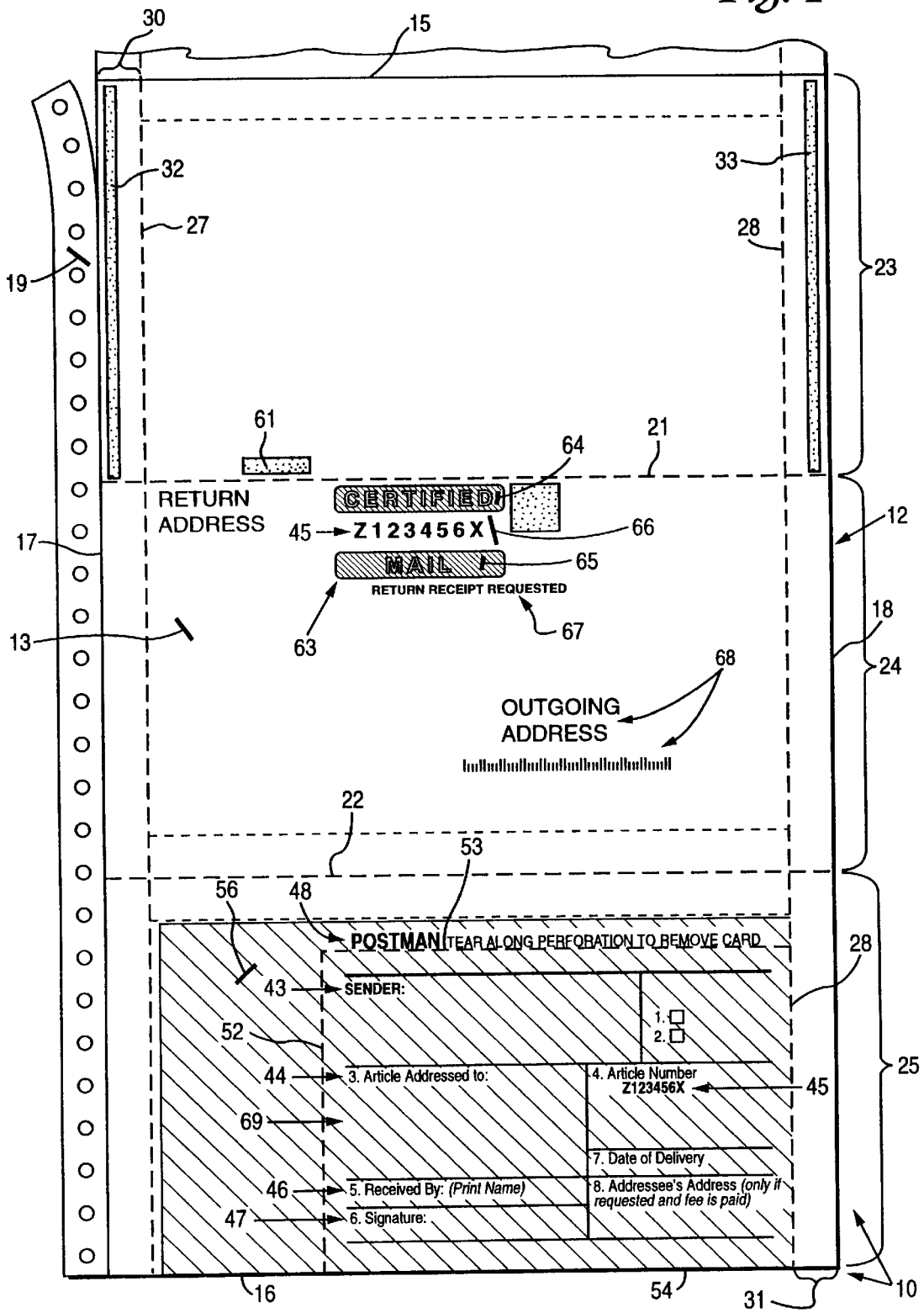
FIG. 1 is a top plan view of one face of an exemplary mailer type business form intermediate according to the present invention.
Figure 3:
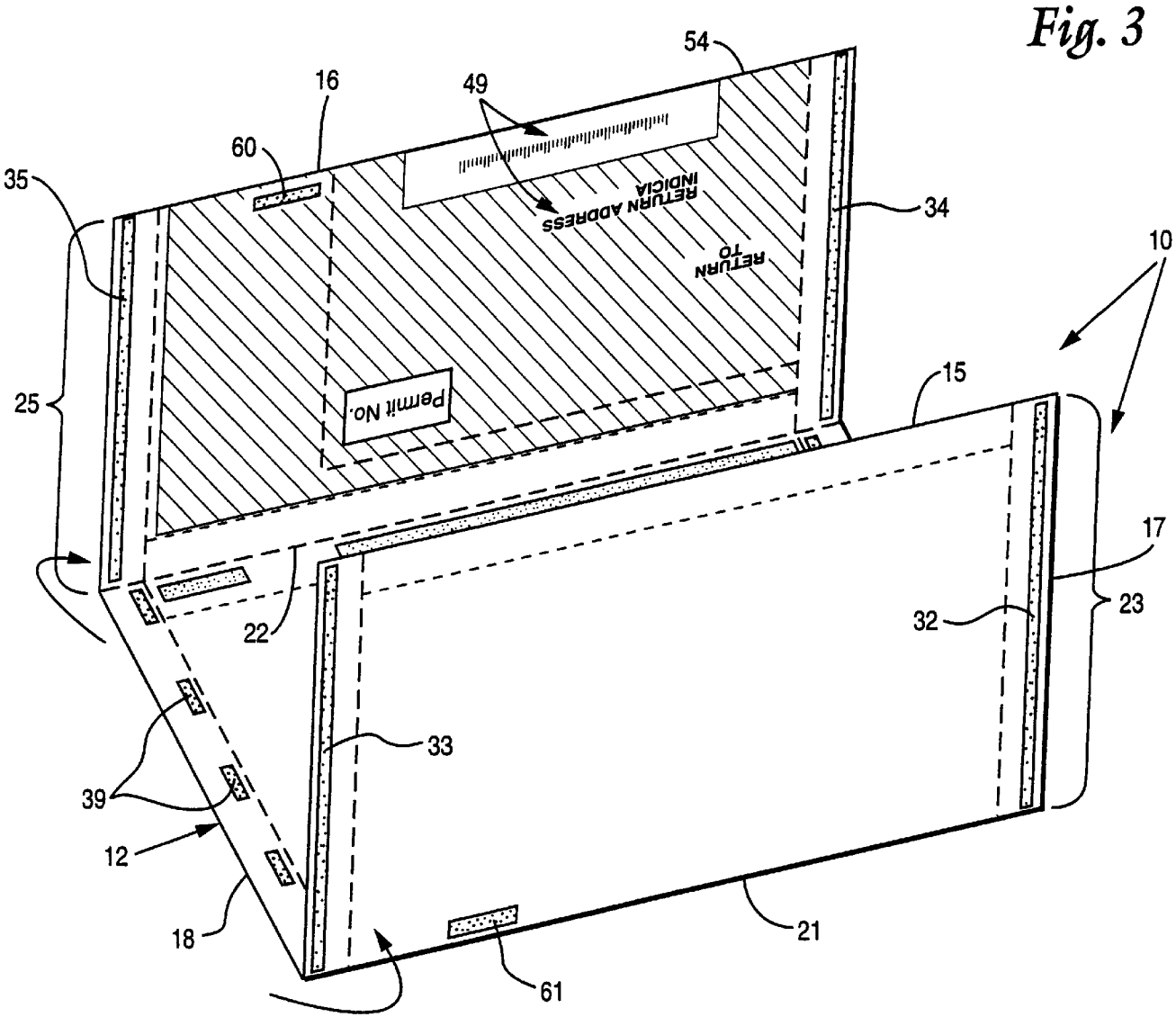
FIG. 3 is a top perspective view of the intermediate of FIGS. 1 and 2 shown being C-folded about the fold lines thereof.

An exemplary intermediate for a C-fold mailer type business form according to the present invention is shown generally by reference numeral 10 in FIGS. 1 and 3. The intermediate 10 is ultimately used to produce a mailer shown schematically at 11 in FIG. 4. The intermediate 10 preferably comprises a single sheet of paper 12 (which may have a weight up to that commonly known as paperboard). At some point during the processing the sheet 12 may be in web form, such as illustrated schematically in FIG. 1 wherein another intermediate is provided attached to the intermediate 10 at the top end thereof. In some stages during processing the sheet 12 may also be part of a web two or more intermediates 10 wide.

A sheet of paper 12 defining the intermediate 10 has first and second faces 13 (FIG. 1) and 14 (FIG. 2), first and second end lines (which are edges or ultimately become edges upon detachment along the line of weakness) 15, 16, which are substantially parallel to each other, and first and second side lines 17, 18 (which are edges or ultimately become edges), the side lines 17, 18, substantially parallel to each other and substantially perpendicular to the end lines 15, 16. If desired, tractor drive strips 19—only one of which is shown in FIG. 1—may be provided along the side lines 17, 18 during processing to facilitate automatic handling of the intermediate 10. However, the tractor drive strips 19 are typically either slit off, or detached at perforation lines or the like, at some point prior to formation of the mailer 11.

The intermediate 10 also comprises first and second fold lines 21, 22 substantially perpendicular to the end lines 15, 16, and defining—with the end lines, 15, 16—the intermediate 10 into first, second, and third panels 23 through 25, respectively. The first panel 23 is between the lines 15, 21, and the second panel 24 between the lines 21, 22, the third panel 25 between the lines 22, 16.

The intermediate 10 also comprises first and second lines of weakness 27, 28 adjacent but spaced from the side lines 17, 18 and substantially parallel thereto. The lines of weakness 27, 28 may be any conventional type of line of weakness, but preferably are perforation lines. The lines of weakness 27, 28 define first and second tear-off edges 30, 31, which facilitate ready opening of the final mailer 11 produced.

In the preferred embodiment illustrated in the drawings, the panels 23–25 each have substantially the same dimensions so that a regular C-fold mailer is provided. However, the dimensions of one or more of the panels 23–25, particularly the dimension along the side lines 17, 18, may be slightly less for one of the panels (typically either the panel 23 or 25, or perhaps both) so that a modified form of a C-fold mailer is provided (within the scope of the description "C-fold" used herein).

The intermediate 10 also comprises first patterns of adhesive or cohesive formed in the tear-off edges 30, 31 for holding the sheet 12 in a mailer configuration 11 when C-folded about the fold lines 21, 22 to provide the first panel 23 between the second and third panels 24, 25. The first patterns of adhesive or cohesive may comprise any conventional configurations and types of adhesive or cohesive, but preferably are of pressure activated cohesive as described in the '128 patent and other patents referenced above. The first patterns of adhesive or cohesive will thus be described herein with respect to strips (continuous or interrupted) of cohesive, but it is to be understood that these are merely exemplary.

In the exemplary embodiment illustrated in the drawings, the first pattern of cohesive comprises the strips 32, 33 (see FIG. 1) on the first face 13 in the tear-off edges 30, 31 in the first panel 33. The strips 32, 33 are designed to cooperate—when the intermediate 10 is C-folded about the fold lines 21, 22—with the substantially identical strips of cohesive 34, 35 provided in the tear-off strips 30, 31 of the third panel 25 on the second face 14 of the intermediate 10 (see FIG. 2). An interrupted strip of cohesive 36 provided in the tear-off edge 31 cooperates with the elements of the interrupted strip of cohesive 37 provided in panel 24 so that upon folding about the fold line 21 the elements 36, 37 engage each other. Similarly, elements 38, 39 are provided in the panels 23, 24 of the tear-off edge 30 (see FIG. 2). When pressure activated cohesive is used, to form the final mailer 11 once the cooperating strips of cohesive 32, 34 and 33, 35 and 36, 37 and 38, 39 are in operative engagement with each other, the mailer 11 is passed through conventional sealing equipment (such as the SpeediSealer® equipment available from Moore U.S.A. of Lake Forest, Ill.) to form a secure seal.

Figure 2:
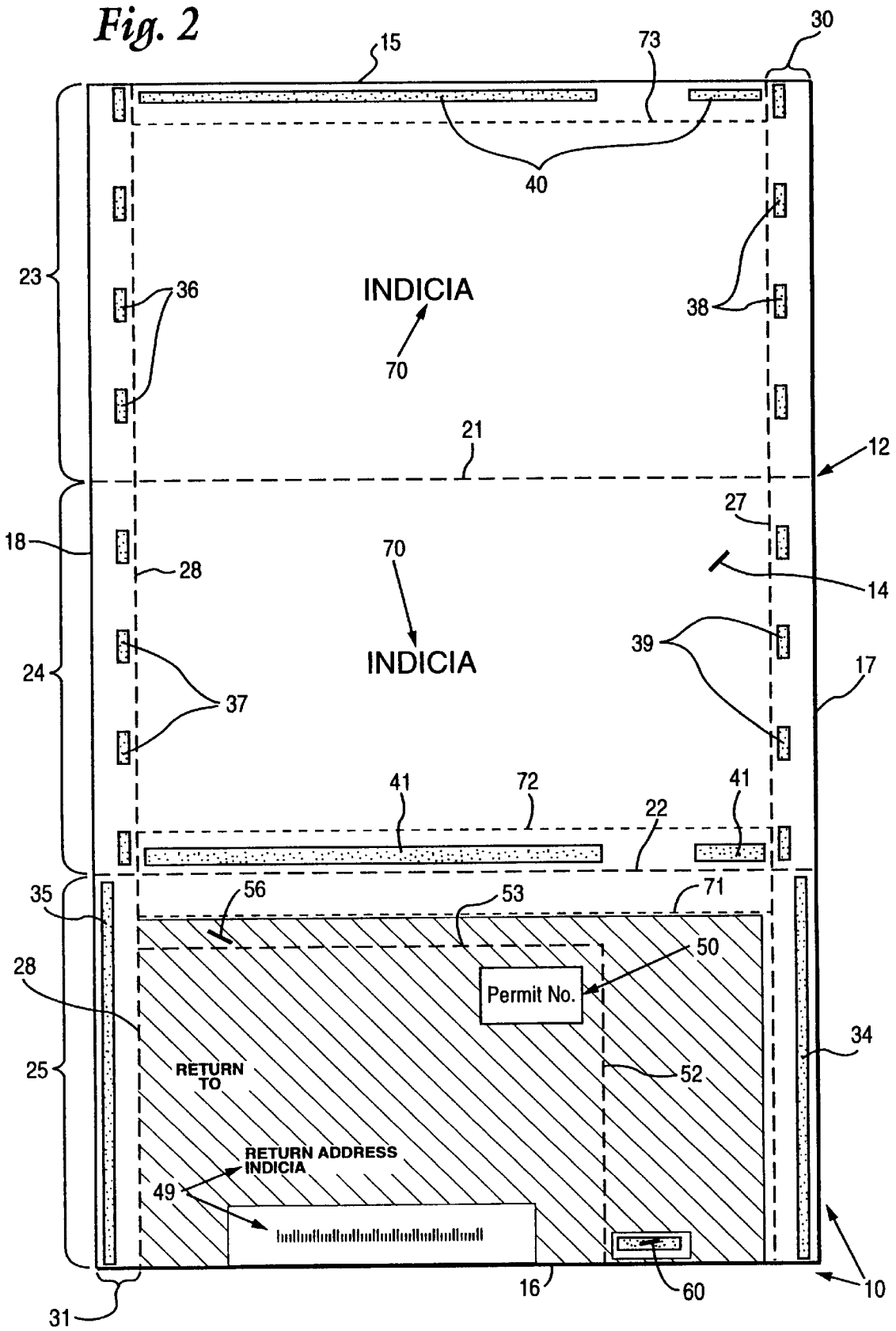
FIG. 2 is a top plan view of the opposite face of the intermediate of FIG. 1.

The intermediate 10 may also comprise a second pattern of adhesive or cohesive, such as the interrupted strips (with one element much longer than the other) 40, 41 illustrated in FIG. 2. The strips 40, 41 are substantially parallel to the end edges 15, 16. The strip 40 is disposed on face 14 adjacent the end line 15, and the strip 41 is disposed on face 14 in panel 24 adjacent the second fold line 22. Thus, when the intermediate 10 is folded about the fold line 21 the strips 40, 41 come into operative engagement with each other. The strips 40, 41 are pressure activated cohesive in the embodiment illustrated but, again, can be any type of suitable conventional adhesive or cohesive.

What has heretofore been described is known per se in the art. What is provided according to the present invention is a unique utilization of the C-fold intermediate described above so that it functions to produce a certified or registered mailer piece.

Imaged on both the first and second faces 13, 14 of the third panel 25 is conventional return receipt indicia for a return receipt card. For example, on the face 13 of the panel 25 is provided informational indicia of a conventional return receipt card, including indicia 43 about the sender, the addressee indicia 44, a variable indicia unique identifying identification string 45 (typically a combination of letters and numbers, as schematically illustrated), a "received by" area for the printed name of the recipient, 46, and a signature line 47 for the recipient to sign. Other conventional indicia are provided but not specifically indicated by a reference numeral in FIG. 1, and also there is instructional indicia to the postman or the like that is typically provided, as illustrated at 48.

The certified or registered return receipt indicia that is imaged on the second face 14 on the third panel 25 is seen in FIG. 2, and typically includes at least the return address indicia (typically in both human and machine readable form) 49, postal permit number indicia 50, and any other like suitable indicia, all or most of which are normally non-variable.

The intermediate 10 according to the invention also comprises a plurality of lines of weakness formed in the third panel 25 adjacent the return receipt indicia 43–50 to define a return receipt card 51 (see FIG. 5) of basically conventional size and construction. The card 51 has the return receipt indicia 43–47, 49 and 50 thereon. In the preferred embodiment illustrated, the lines of weakness include one of the first and second lines of weakness (in this case the second line of weakness 28), a third line of weakness 52 substantially parallel to the second line weakness 28, and a fourth line of weakness 53 substantially parallel to the second end 16. The lines of weakness 52, 53 preferably are perforation lines. In order to provide maximum simplicity with optimum functionality, preferably the bottom edge 54 of the return receipt card 51 is coincident with the second end edge 16 of the intermediate 10, and there is no sealing adhesive acting between any part of the card 51 and any other part of the intermediate 10. While tacking adhesive may be provided between the panels 25, 23 along the edge 54, that also is preferably avoided, so as to make the return receipt card 51 as readily removable as possible.

The third panel 25 first and second faces 13, 14—at least in the area encompassed by the return receipt card 51—preferably is printed with green background ink, as illustrated schematically by the shaded area 56 seen in both FIGS. 1 and 2. The green color of the shaded area 56 is such that the return receipt card 51 looks just like a conventional return receipt card in conventional certified mail or registered mail forms.

Figure 5:
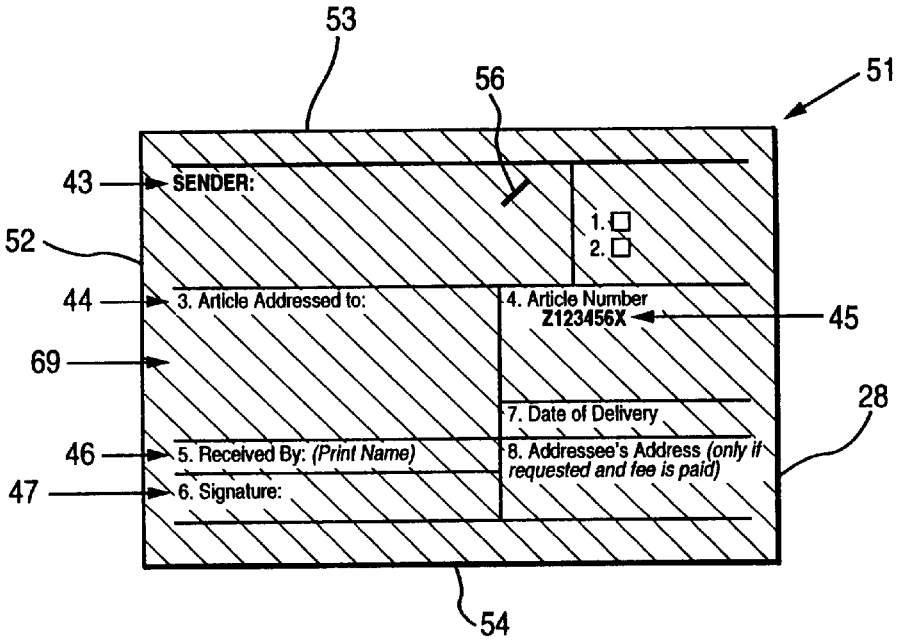
FIG. 5 is a top perspective view of a return receipt card of the intermediate and form of FIGS. 1 through 4 show detached therefrom.

As seen in both FIGS. 1 and 5, preferably the signature line indicia 47 is immediately above the bottom edge 54 of the return receipt card 51. Also, preferably a third adhesive or cohesive pattern is disposed on at least one of the third panel 25 second face 14 in the first panel 23 first face 13 to hold the first and third panels 23, 25 together in an area thereof that is outside of (designated an overlap area) the card 51. For example, for the embodiment illustrated in FIGS. 1 and 2, where pressure activated cohesive is provided, a first spot or cohesive 60 (see FIG. 2) is provided in the overlap area of the panel 25, exterior of the perforation lines 28, 52, 53, and adjacent the second end edge 16, while a cooperating spot element 61 (see FIG. 1) is provided on the first face 13 in the first panel 23 adjacent the first fold line 21. In this way when the intermediate 10 is C-folded (as illustrated schematically in FIG. 3), the elements 60, 61 will come into contact with each other and provide a seal which helps close an open edge of the mailer 11 yet does not interfere with the ready removability of the card 51. Preferably, the element 60 is immediately adjacent the line of weakness 52.

The intermediate 10 also comprises certified or register mail notification indicia, shown generally by reference numeral 63 in FIG. 1, imaged on the first face 13 of the second panel 24. The certified or registered mail notification indicia 63 is conventional, typically including two green background areas/stripes 64, 65 with a white area 66 between them, the words "certified mail" or the like imaged in the stripes 64, 65, and a variable indicia unique identification string 45 imaged in the white background area 66. The identification string 45 imaged in the panel 24 is substantially the same as the identification string 45 imaged in the panel 25. Other conventional indicia is also typically provided in this area as indicated schematically by reference numeral 67.

The first face of the second panel 24 also has an outgoing address indicia area which is the right corner area of the panel 24 as seen in FIG. 1. At some point in time during the processing of the intermediate 10 the variable outgoing address indicia 68 (which preferably is in both human and machine readable form) is imaged on that area as seen in FIG. 1. Preferably, substantially the same variable outgoing address indicia (but perhaps without the machine readable component) may be imaged as indicated at the area 69 in FIG. 1 on the first face 13 of the third panel 25 in the "3. Article Addressed to:" box of the conventional indicia 44 of the card 51. Other, typically non-variable, indicia indicated only schematically at 70 in FIG. 2, is imaged on the second face 14 of the panels 23, 24 to provide information or instructional indicia to the outgoing addressee (68) who receives the mailer 11.

The intermediate 10 may also have a wide variety of other conventional features, such as other lines of weakness [such as the lines of weakness 71, 72, 73 in the FIG. 2 illustration] to even further facilitate ready opening of the mailer 11 or detachment of the parts thereof. Other conventional features may also be provided including a wide variety of conventional instructional indicia telling the outgoing addressee (68) how to open up the mailer 11.

FIG. 3 schematically illustrates folding of the intermediate 10 about the fold lines to form the mailer 11. The intermediate 10 is first folded about the fold line 21 so that the first face 13 thereof faces away from the second panel 24, and then the third panel 25 is folded about the fold line 21 so that the second face 14 thereof comes into contact with the first face 13 of the first panel 23 so that the first panel 23 is sandwiched between the panels 24, 25. Once C-folded, the intermediate/mailer is then passed through conventional sealing equipment (such as a SpeediSealer® sealing unit when pressure activated cohesive is used) to seal all of the cohesive or adhesive elements to each other or to the paper forming the sheet 12 (e.g. the elements 60, 61 sealed together, the elements 33, 35 sealed together, etc.).

Figure 4:
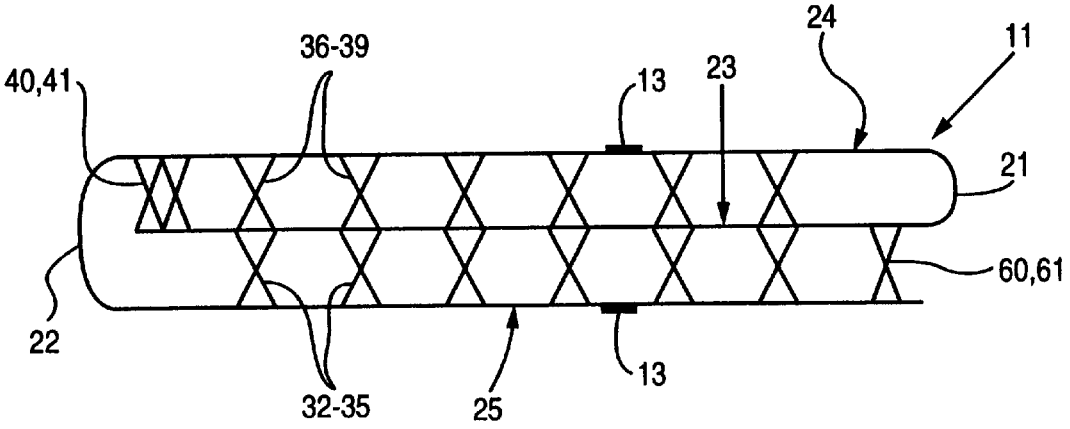
FIG. 4 is a side diagrammatic view illustrating the relationship between the elements of the mailer type business form according to the invention when formed by C-folding the intermediate as illustrated in FIG. 3 and passed through a sealing unit.

In the final mailer 11 illustrated schematically in FIG. 4, the top panel thereof is the middle panel 24 with the first face 13 thereof facing outwardly so that the indicia 63, 68 is readily visible. The cohesive elements 36–39 hold the second faced 14 of the top panel 24 in contact with the second face 14 of the now intermediate panel 23 (which used to be the first panel 23). The bottom panel 25 (formerly the third panel 25) first face 13 also faces outwardly so that the indicia 43–48 is readily visible from the outside of the mailer 11. The other cohesive elements 32–35, 40, 41 and 60, 61 are also schematically illustrated in FIG. 4.

Once the mailer 11 is received by the outgoing addressee (68), the postman has the recipient print his/her name at the indicia area 46 and sign it at the signature line 47, then the postman separates the return receipt card 51 along the lines of weakness 28, 52, 53 and mails it back to the return addressee (indicia 49 as seen in FIGS. 2 and 3).

It will thus be seen that according to the present invention a simple yet effective C-fold mailer type business form intermediate, and mailer formed from the intermediate, are provided which allow effective use of certified or registered mail return receipt forms, and have an inexpensive and simple construction. The intermediate 10 may be readily imprinted by a single pass through a duplex printer with all the indicia printed on each of the faces 13, 14 at the same time, or in a staggered relationship, but with the common indicia 68, 69 and 45 printed variably at the same time on the face 13. The indicia on the face 14 may be preprinted at another location (as can the non-variable indicia on face 13), in which case only a simplex printer is necessary.

While the invention has been herein shown and described in what is presently conceived to be the most practical and preferred embodiment thereof, it will be apparent to those skilled in the art that many modifications may be made thereof within the scope of the invention, which scope is to be accorded the broadest interpretation of the appended claims so as to encompass all equivalent structures and devices.

What is claimed is:

1. A C-fold mailer type business form intermediate comprising:

a sheet of paper having first and second faces, first and second end lines substantially parallel to each other, and first and second side lines substantially parallel to each other and substantially perpendicular to said end lines;

first and second fold lines substantially parallel to said end lines and forming said sheet into first, second and third panels;

first and second lines of weakness spaced from but adjacent said side lines and substantially parallel thereto and effectively extending the entire length thereof, defining first and second tear-off edges;

first patterns of adhesive or cohesive formed in said tear-off edges for holding said sheet in a mailer configuration when folded about said fold lines to provide said first panel between said second and third panels;

certified or registered mail return receipt indicia imaged on said third panel first and second faces, including a signature line imaged on said third panel first face substantially parallel to said first and second fold lines;

a plurality of lines of weakness formed in said third panel adjacent said return receipt indicia to define a readily removable return receipt card with said return receipt indicia thereon;

certified or registered mail notification indicia imaged on said second panel first face; and an outgoing address indicia area on said second panel first face for receipt of variable outgoing address indicia thereon.

2. An intermediate as recited in claim 1 further comprising variable outgoing address indicia imaged in said outgoing address indicia area, and wherein said notification indicia and said return receipt card first face have substantially the same variable indicia identification string imaged thereon.

3. An intermediate as recited in claim 1 wherein said second end line comprises an end edge, and wherein said second end edge comprises a first edge of said return receipt card, devoid of sealing adhesive connection to said first panel along said first edge.

4. An intermediate as recited in claim 3 wherein said signature line indicia is adjacent said second end edge.

5. An intermediate as recited in claim 3 wherein said second end edge is significantly longer than said first edge of said return receipt card, said second end edge having an overlap area; and further comprising a second adhesive or cohesive pattern disposed on at least one of said third panel second face adjacent said second end edge and said first panel first face adjacent said first fold line, to hold said first and third panels together in said overlap area when said intermediate is C-folded about said fold lines with said first panel between said second and third panels.

6. An intermediate as recited in claim 1 wherein said third panel first and second faces, in substantially the entire area between said lines of weakness, are printed green.

7. An intermediate as recited in claim 3 wherein one of the lines of weakness defining said return receipt card comprises one of said first or second lines of weakness.

8. An intermediate as recited in claim 3 wherein said first patterns of adhesive or cohesive comprise cooperating patterns of pressure activated cohesive provided in said tear-off edges on said first panel first and second faces, second panel second face only, and third panel second face only.

9. An intermediate as recited in claim 5 wherein said first patterns of adhesive or cohesive comprise cooperating patterns of pressure activated cohesive provided in said tear-off edges on said first panel first and second faces, second panel second face only, and third panel second face only.

10. An intermediate as recited in claim 9 wherein said second pattern comprises cooperating spots of pressure activated cohesive provided on both said third panel second face and first panel first face.

11. An intermediate as recited in claim 1 wherein said first patterns of adhesive or cohesive comprise cooperating patterns of pressure activated cohesive provided in said tear-off edges on said first panel first and second faces, second panel second face only, and third panel second face only.

12. A C-fold mailer type business form intermediate comprising:

a sheet of paper having first and second faces, first and second end lines substantially parallel to each other, and first and second side lines substantially parallel to each other and substantially perpendicular to said end lines;

first and second fold lines substantially parallel to said end lines and forming said sheet into first, second and third panels;

first and second lines of weakness spaced from but adjacent said side lines and substantially parallel thereto and effectively extending the entire length thereof, defining first and second tear-off edges;

first patterns of adhesive or cohesive formed in said tear-off edges for holding said sheet in a mailer configuration when folded about said fold lines to provide said first panel between said second and third panels;

certified or registered mail return receipt indicia imaged on said third panel first and second faces, including a signature line imaged on said third panel first face substantially parallel to said first and second fold lines;

a plurality of lines of weakness formed in said third panel adjacent said return receipt indicia to define a readily removable return receipt card with said return receipt indicia thereon; and wherein said second end line comprises an end edge, and wherein said second end edge comprises a first edge of said return receipt card, devoid of sealing adhesive connection to said first panel along said first edge.

13. An intermediate as recited in claim 12 wherein said signature line indicia is adjacent said second end edge.

14. An intermediate as recited in claim 13 wherein said second end edge is significantly longer than said first edge of said return receipt card, said second end edge having an overlap area; and further comprising a second adhesive or cohesive pattern disposed on at least one of said third panel second face adjacent said second end edge and said first panel first face adjacent said first fold line, to hold said first and third panels together in said overlap area when said intermediate is C-folded about said fold lines with said first panel between said second and third panels.

15. An intermediate as recited in claim 13 wherein said third panel first and second faces, at least in the area encompassed by said return receipt card, are printed green.

16. An intermediate as recited in claim 13 wherein one of the lines of weakness defining said return receipt card comprises one of said first or second lines of weakness.

17. A certified or registered return receipt requested mailer type business form comprising:

a top panel having a top face with outgoing address indicia and certified or registered mail notification indicia thereon including a variable indicia identification string;

an intermediate panel between said top panel and a bottom panel;

said bottom panel having a bottom face with certified or registered return receipt indicia imaged thereon including a signature line and substantially said same identification string;

a plurality of lines of weakness defining a portion of said bottom panel, which portion contains said return receipt indicia, into a return receipt card;

green printing on said bottom panel bottom face in at least the area of said return receipt card;

first and second tear-off strips formed adjacent the complete opposite side edges of all three of said panels and defined by lines of weakness, said lines of weakness substantially perpendicular to said signature line; and adhesive or cohesive holding said intermediate panel to said top and bottom panels at least at said tear-off strips.

18. A mailer type business form as recited in claim 17 wherein said return receipt card has an edge adjacent and substantially parallel to said signature line indicia defined by a first edge of said bottom panel, and said bottom and intermediate panels are devoid of sealing adhesive thereat; and wherein one of said lines of weakness defining said return receipt card comprises one of said lines of weakness defining said tear-off edges.

19. A mailer type business form as recited in claim 18 further comprising adhesive or cohesive acting between said bottom and intermediate panels along said first edge of said bottom panel but spaced from said return receipt card.

20. An intermediate as recited in claim 12 wherein said first patterns of adhesive or cohesive comprise cooperating patterns of pressure activated cohesive provided only in said tear-off edges on said first panel first and second faces, second panel second face only, and third panel second face.

* * * * *